US009817345B2

(12) United States Patent
Yamano et al.

(10) Patent No.: US 9,817,345 B2
(45) Date of Patent: Nov. 14, 2017

(54) FIXING DEVICE, IMAGE FORMING APPARATUS, AND METHOD OF CONTROLLING FIXING DEVICE

(71) Applicants: Motoyoshi Yamano, Kanagawa (JP); Tetsuo Tokuda, Tokyo (JP); Yoshikuni Sasaki, Kanagawa (JP); Hiroshi Ono, Tokyo (JP); Hironori Yamaoka, Kanagawa (JP); Ryohhei Sugiyama, Kanagawa (JP); Kohichi Utsunomiya, Kanagawa (JP); Arinobu Yoshiura, Miyagi (JP); Hideo Nagafuji, Kanagawa (JP)

(72) Inventors: Motoyoshi Yamano, Kanagawa (JP); Tetsuo Tokuda, Tokyo (JP); Yoshikuni Sasaki, Kanagawa (JP); Hiroshi Ono, Tokyo (JP); Hironori Yamaoka, Kanagawa (JP); Ryohhei Sugiyama, Kanagawa (JP); Kohichi Utsunomiya, Kanagawa (JP); Arinobu Yoshiura, Miyagi (JP); Hideo Nagafuji, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/352,782

(22) Filed: Nov. 16, 2016

(65) Prior Publication Data

US 2017/0146933 A1 May 25, 2017

(30) Foreign Application Priority Data

Nov. 25, 2015 (JP) ..... 2015-229566

(51) Int. Cl.
*G03G 15/20* (2006.01)

(52) U.S. Cl.
CPC ..... *G03G 15/2039* (2013.01)

(58) Field of Classification Search
CPC ..... G03G 15/2039
(Continued)

(56) References Cited

U.S. PATENT DOCUMENTS

2011/0020024 A1* 1/2011 Berg ..... G03G 15/2064 399/67
2011/0026988 A1 2/2011 Yoshikawa et al.
(Continued)

FOREIGN PATENT DOCUMENTS

JP 07319320 A * 12/1995
JP 11084782 A * 3/1999
(Continued)

*Primary Examiner* — Susan Lee
(74) *Attorney, Agent, or Firm* — Harness, Dickey & Pierce, P.L.C.

(57) ABSTRACT

A fixing device includes a heater, a fixing rotator, a pressure rotator to press against the fixing rotator to form a fixing nip between the fixing rotator and the pressure rotator, through which a recording medium is conveyed, a moving device to move the pressure rotator in directions in which the pressure rotator comes into contact with and separates from the fixing rotator, a thermal expansion amount predictor to predict an amount of thermal expansion of the fixing rotator while the recording medium is conveyed, and a nip width adjuster to control a moving distance of the pressure rotator moved by the moving device toward the fixing rotator, depending on the amount of thermal expansion of the fixing rotator predicted by the thermal expansion amount predictor, so as to adjust a width of the fixing nip to maintain a substantially constant width of the fixing nip.

8 Claims, 6 Drawing Sheets

(58) Field of Classification Search
USPC ..... 399/67
See application file for complete search history.

(56) References Cited

U.S. PATENT DOCUMENTS

| | | | |
|---|---|---|---|
| 2011/0058865 | A1 | 3/2011 | Tokuda et al. |
| 2011/0058866 | A1 | 3/2011 | Ishii et al. |
| 2011/0222887 | A1 | 9/2011 | Tao et al. |
| 2011/0311246 | A1 | 12/2011 | Masuda et al. |
| 2011/0311249 | A1 | 12/2011 | Kubota et al. |
| 2012/0087688 | A1 | 4/2012 | Kubota |
| 2012/0121305 | A1 | 5/2012 | Yoshikawa et al. |
| 2014/0219672 | A1 | 8/2014 | Samei et al. |
| 2014/0219696 | A1 | 8/2014 | Fujimoto et al. |
| 2014/0227001 | A1 | 8/2014 | Kishi et al. |
| 2016/0011550 | A1 | 1/2016 | Utsunomiya et al. |

FOREIGN PATENT DOCUMENTS

| | | | | |
|---|---|---|---|---|
| JP | 2007-072289 | | 3/2007 | |
| JP | 2010-156818 | | 7/2010 | |
| JP | 2010-204222 | | 9/2010 | |
| JP | 2011-186395 | | 9/2011 | |
| JP | 2012-003171 | | 1/2012 | |
| JP | 2012-022298 | | 2/2012 | |
| JP | 2012-042755 | | 3/2012 | |
| JP | 2012-042756 | | 3/2012 | |
| JP | 2012-083454 | | 4/2012 | |
| JP | 2012194421 | A * | 10/2012 | ..... G03G 15/2032 |
| JP | 2014-219651 | | 11/2014 | |
| JP | 2015-069041 | | 4/2015 | |

* cited by examiner

FIXING DEVICE, IMAGE FORMING APPARATUS, AND METHOD OF CONTROLLING FIXING DEVICE

CROSS-REFERENCE TO RELATED APPLICATION

This patent application is based on and claims priority pursuant to 35 U.S.C. §119(a) to Japanese Patent Application No. 2015-229566, filed on Nov. 25, 2015, in the Japan Patent Office, the entire disclosure of which is hereby incorporated by reference herein.

BACKGROUND

Technical Field

Embodiments of the present disclosure generally relate to a fixing device, an image forming apparatus, and a method of controlling a fixing device, and more particularly, to a fixing device for fixing a toner image on a recording medium, an image forming apparatus for forming an image on a recording medium and incorporating the fixing device, and a method of controlling a fixing device.

Related Art

Various types of electrophotographic image forming apparatuses are known, including copiers, printers, facsimile machines, and multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor as an image bearer. An optical writer irradiates the surface of the photoconductor thus charged with a light beam to form an electrostatic latent image on the surface of the photoconductor according to the image data. A developing device supplies toner to the electrostatic latent image thus formed to render the electrostatic latent image visible as a toner image. The toner image is then transferred onto a recording medium either directly, or indirectly via an intermediate transfer belt. Finally, a fixing device applies heat and pressure to the recording medium bearing the toner image to fix the toner image onto the recording medium. Thus, the image is formed on the recording medium.

Such a fixing device typically includes a fixing rotator such as a roller, a belt, or a film, and an opposed rotator such as a roller or a belt pressed against the fixing rotator. The toner image is fixed onto the recording medium under heat and pressure while the recording medium is conveyed between the fixing rotator and the opposed rotator.

SUMMARY

In one embodiment of the present disclosure, a novel fixing device is described that includes a heater, a fixing rotator, a pressure rotator, a moving device, a thermal expansion amount predictor, and a nip width adjuster. The fixing rotator includes a cored bar and an elastic layer coating the cored bar. The pressure rotator presses against the elastic layer of the fixing rotator to form a fixing nip between the fixing rotator and the pressure rotator, through which a recording medium is conveyed. The moving device moves the pressure rotator in directions in which the pressure rotator comes into contact with and separates from the fixing rotator. The thermal expansion amount predictor predicts an amount of thermal expansion of the fixing rotator while the recording medium is conveyed. The nip width adjuster controls a moving distance of the pressure rotator moved by the moving device toward the fixing rotator, so as to adjust a width of the fixing nip. The nip width adjuster controls the moving distance of the pressure rotator depending on the amount of thermal expansion of the fixing rotator predicted by the thermal expansion amount predictor, so as to maintain a substantially constant width of the fixing nip.

Also described is a novel image forming apparatus incorporating the fixing device.

Also described is a novel method of controlling a fixing device. The method includes predicting an amount of thermal expansion of a fixing rotator of the fixing device based on a detected temperature of the fixing rotator and a detected elapsed time from when heating starts, and controlling a moving distance of a pressure rotator of the fixing device depending on the amount of thermal expansion of the fixing rotator predicted, so as to maintain a substantially constant width of a fixing nip between the fixing rotator and the pressure rotator.

BRIEF DESCRIPTION OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein.

The accompanying drawings are intended to depict embodiments of the present disclosure and should not be interpreted to limit the scope thereof. Also, identical or similar reference numerals designate identical or similar components throughout the several views.

DETAILED DESCRIPTION

Figure 1:
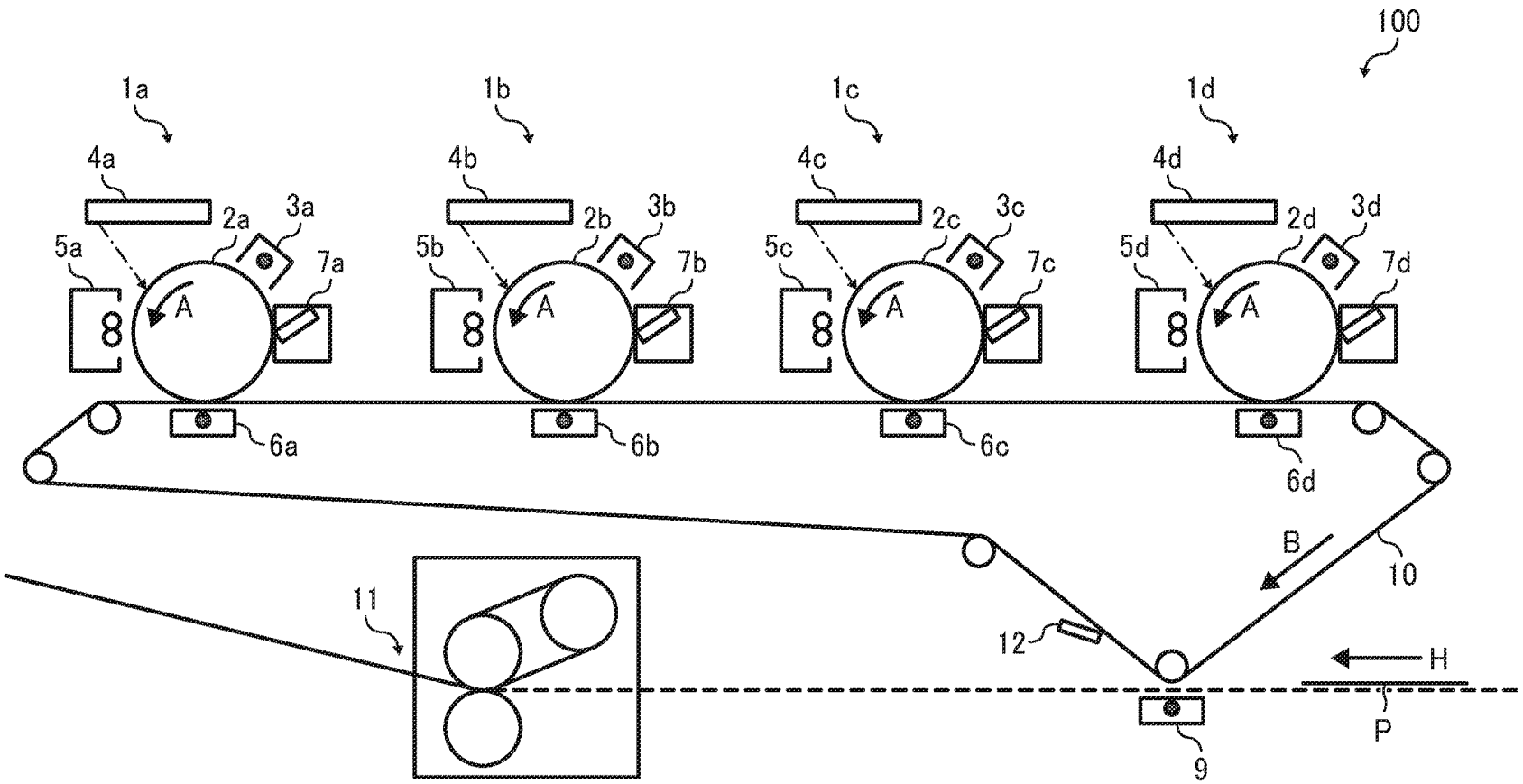
FIG. 1 is a schematic view of an image forming apparatus according to an embodiment of the present disclosure.

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and not all of the components or elements described in the embodiments of the present disclosure are indispensable to the present disclosure.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

As used herein, the singular forms "a", "an", and "the" are intended to include the plural forms as well, unless the context clearly indicates otherwise.

It is to be noted that, in the following description, suffixes Y, M, C, and K denote colors yellow, magenta, cyan, and black, respectively. To simplify the description, these suffixes are omitted unless necessary.

Referring now to the drawings, embodiments of the present disclosure are described below.

Initially with reference to FIG. 1, a description is given of an image forming apparatus 100 according to an embodiment of the present disclosure.

FIG. 1 is a schematic view of the image forming apparatus according to an embodiment of the present disclosure.

The image forming apparatus 100 is a tandem color laser printer that forms color and monochrome toner images on recording media by electrophatography. Specifically, the image forming apparatus 100 includes, e.g., a transfer belt 10 and four image forming devices 1*a*, 1*b*, 1*c*, and 1*d* that form toner images of yellow (Y), magenta (M), cyan (C), and black (K), respectively. The image forming apparatus 100 employs a tandem structure in which the image forming devices 1*a*, 1*b*, 1*c*, and 1*d* are aligned in this order in a rotational direction B of the transfer belt 10 as illustrated in FIG. 1.

The image forming devices 1*a*, 1*b*, 1*c*, and 1*d* respectively include photoconductors 2*a* through 2*d*, a drum-shaped chargers 3*a* through 3*d*, exposure devices 4*a* through 4*d*, developing devices 5*a* through 5*d*, primary transfer devices 6*a* through 6*d*, and cleaners 7*a* through 7*d*. The photoconductors 2*a* through 2*d* are drum-shaped photoconductors and rotate in a rotation direction A as illustrated in FIG. 1. The drum-shaped chargers 3*a* through 3*d* uniformly charge the surface of the photoconductors 2*a* through 2*d*, respectively. The exposure devices 4*a* through 4*d* respectively irradiate the charged surface of the photoconductors 2*a* through 2*d* with laser light to form electrostatic latent images on the surface of the photoconductors 2*a* through 2*d* according to image data. The developing devices 5*a* through 5*d* respectively develop the electrostatic latent images formed on the surface of the photoconductors 2*a* through 2*d* with toner, rendering the electrostatic latent images visible as toner images. The primary transfer devices 6*a* through 6*d* transfer the toner images from the surface of the photoconductors 2*a* through 2*d* onto the transfer belt 10. The cleaners 7*a* through 7*d* clean the surface of the photoconductors 2*a* through 2*d*, respectively.

In the image forming apparatus 100, the toner images of yellow, magenta, cyan, and black respectively formed on the surface of the photoconductors 2*a* through 2*d* are superimposed one atop another on the transfer belt 10, thereby being transferred onto the transfer belt 10. Thus, a composite color toner image is formed on the transfer belt 10. When the color toner image formed on the transfer belt 10 reaches a position where the color toner image faces a secondary transfer device 9, in accordance with rotation of the transfer belt 10, a high voltage applied to the secondary transfer device 9 transfers the color toner image onto a recording medium P conveyed in a recording medium conveyance direction H and passing between the secondary transfer device 9 and the transfer belt 10. A belt cleaner 12 collects residual toner, failed to be transferred onto the recording medium P and therefore remaining on the transfer belt 10, from the transfer belt 10. The recording medium P bearing the color toner image is conveyed to a fixing device 11. The fixing device 11 fixes the color toner image onto the recording medium P.

Figure 2:
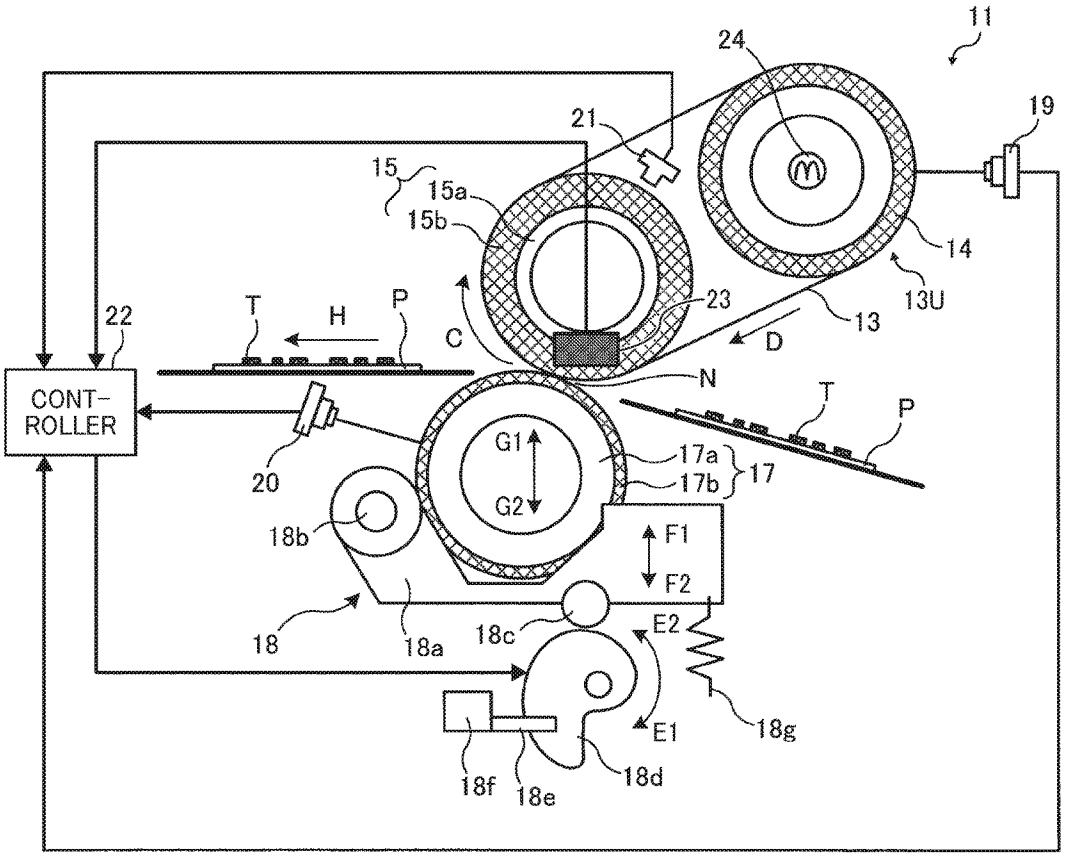
FIG. 2 is a schematic view of a fixing device incorporated in the image forming apparatus of FIG. 1.

Referring now to FIG. 2, a description is given of the fixing device 11 incorporated in the image forming apparatus described above.

FIG. 2 is a schematic view of the fixing device 11.

The fixing device 11 includes a fixing belt 13 as a fixing rotator to fix a toner image on a recording medium. In addition to the fixing belt 13 that is formed into a loop, the fixing device 11 includes a heating roller 14 provided with a heater 24, a fixing roller 15 as another fixing rotator, a pressure roller 17 as a pressure rotator, a pressure roller moving mechanism 18 as a moving device, a fixing belt temperature sensor 19, a pressure roller temperature sensor 20, a fixing roller temperature sensor 21, a controller 22, and a cored bar temperature sensor 23. The fixing roller 15 includes a cored bar 15*a* and an elastic layer 15*b* coating the cored bar 15*a*. The pressure roller 17 presses against the elastic layer 15*b* of the fixing roller 15 via the fixing belt 13 to form an area of contact herein called a fixing nip N between the fixing roller 15 and the pressure roller 17, more specifically, between the fixing belt 13 and the pressure roller 17. The pressure roller moving mechanism 18 moves the pressure roller 17 in directions in which the pressure roller 17 comes into contact with and separates from the fixing roller 15. The fixing roller temperature sensor 21 and the cored bar temperature sensor 23 are temperature detectors to detect the temperature of the fixing roller 15. The controller 22 is, e.g., a processor such as a central processing unit (CPU) provided with a random-access memory (RAM) and a read-only memory (ROM).

The fixing belt 13 and the components disposed inside the loop formed by the fixing belt 13, that is, the heating roller 14, the heater 24, the fixing roller 15 and the like, may constitute a belt unit 13U detachably coupled to the pressure roller 17.

The fixing belt 13 is an endless belt constructed of a plurality of layers, that is, a base layer made of resin, an elastic layer resting on the base layer, and a release layer resting on the elastic layer. The elastic layer of the fixing belt 13 is made of an elastic material such as fluoro rubber, silicon rubber, or silicon rubber foam. The release layer of the fixing belt 13 is made of, e.g., tetrafluoroethylene-perfluoroalkyl vinyl ether copolymer (PEA), polyimide, polyethermide, or polyether sulfide (PES). The release layer as a surface layer of the fixing belt 13 facilitates separation of toner contained in the toner image T formed on the recording medium P from the fixing belt 13. The fixing belt 13 is entrained around, and thus supported by two rollers, which are the heating roller 14 and the fixing roller 15.

The heating roller 14 is a thin, cylindrical body made of metal. The heater 24 is secured inside the cylindrical body. The heater 24 is, e.g., a halogen heater or carbon heater. The heater 24 has opposed ends secured to side plates of the fixing device 11. The heating roller 14 has opposed axial ends rotatably attached to the side plates of the fixing device 11 via bearings. A power supply, which is an alternating current power supply, of the image forming apparatus 100 supplies the heater 24 with power under output control. Accordingly, the heater 24 generates heat. Radiation heat from the heater 24 heats the heating roller 14, and further heats the surface of the fixing belt 13 by thermal conduction from the heating roller 14. Consequently, the toner image T formed on the recording medium P is heated on the fixing belt 13. The fixing belt temperature sensor 19 (e.g., thermopile) is disposed opposite the surface of the fixing belt 13 to detect a surface temperature of the fixing belt 13. The output of the heater 24 is controlled so as to maintain the surface temperature of the fixing belt 13 at a desired control temperature (i.e., fixing temperature).

The fixing roller 15 is constructed of the cored bar 15*a* made of stainless steel (e.g., steel use stainless or SUS 304) and the elastic layer 15*b* coating the cored bar 15*a*. The elastic layer is, e.g., fluoro rubber, silicone rubber, or silicon rubber foam. The fixing roller 15 has opposed axial ends rotatably attached to the side plates of the fixing device 11 via bearings. A fixing roller driver drives and rotates the fixing roller 15 in a rotational direction C, which is a clockwise direction in FIG. 2. As the fixing roller 15 rotates in the rotational direction C, the fixing belt 13 rotates in a rotational direction D.

The fixing roller 15 and the pressure roller 17 have similar configurations. The pressure roller 17 is constructed of a cored bar 17*a* made of stainless steel (e.g., SUS 304) and an elastic layer 17*b* coating the cored bar 17*a*. The elastic layer 17*b* is, e.g., fluoro rubber, silicone rubber, or silicon rubber foam.

As illustrated in FIG. 2, the pressure roller 17 presses against the fixing roller 15 via the fixing belt 13, thereby forming the fixing nip N between the fixing belt 13 and the pressure roller 17. To form the fixing nip N, the elastic layer 15*b* of the fixing roller 15 is thicker than the elastic layer 17*b* of the pressure roller 17. For example, the elastic layer 17*b* of the pressure roller 17 is about 3 mm whereas the elastic layer 15*b* of the fixing roller 15 is about 15 mm.

The pressure roller moving mechanism 18 includes a swing arm 18*a*, a swing shaft 18*b*, a beating 18*c*, an eccentric earn 18*d*, a shield board 18*e*, an eccentric cam position detector 18*f*, and a swing arm spring 18*g*. The swing arm 18*a* rotatably supports bearings situated at opposed ends of the pressure roller 17. The swing arm 18*a* has an end provided with the swing shaft 18*b*. The swing arm 18*a* swings about the swing shaft 18*b*. The bearing 18*c* is secured to another end of the swing arm 18*a*. As illustrated in FIG. 2, the eccentric cam 18*d* is disposed below the bearing 18*c* to contact the bearing 18*c*. The eccentric cam 18*d* includes a rotational shaft deviating from a circle center, and driven by a motor. The eccentric cam 18*d* is provided with the shield board 18*e*. The eccentric cam position detector 18*f* detects the position of the shield board 18*e* to ascertain a reference position of the eccentric cam 18*d*.

The swing arm spring 18*g* is coupled to the swing arm 18*a*. A tensile force of the swing arm spring 18*g* maintains the eccentric cam 18*d* in contact with the bearing 18*c*. When the motor drives and rotates the eccentric cam 18*d* in a rotational direction E1, the bearing 18*c* moves in a moving direction F1, thereby moving the pressure roller 17 supported by the swing arm 18*a* in a moving direction G1, in which the pressure roller 17 comes into contact with the fixing roller 15. On the other hand, when the motor drives and rotates the eccentric cam 18*d* in a rotational direction E2, the bearing 18*c* moves in a moving direction F2, thereby moving the pressure roller 17 supported by the swing arm 18*a* in a moving direction G2, in which the pressure roller 17 separates from the fixing roller 15.

To heat and melt toner contained in the toner image T formed on the recording medium P to stably fix the toner image T on the recording medium P, the width of fixing nip N (hereinafter referred to as nip width) is determined as appropriate for the type of recording medium P, so that the toner image T is given an optimum amount of heat while the recording medium P bearing the toner image T passes through the fixing nip N formed between the fixing roller 15 and the pressure roller 17, more specifically, between the fixing belt 13 and the pressure roller 17. The nip width can be adjusted by using the pressure roller moving mechanism 18 to move the pressure roller 17 in the directions in which the pressure roller 17 comes into contact with and separates from the fixing roller 15, and controlling the position of the pressure roller 17 relative to the fixing roller 15. However, expansion of the elastic layer 15*b* of the fixing roller 15 in accordance with a temperature rise may vary the nip width, even when the position of the pressure roller 17 is set to a predetermined position relative to the fixing roller 15, causing unstable fixability and lowering the fixing quality.

Particularly, if the recording medium P is constructed of a plurality of sheets of paper, such as an envelope, inappropriate control of the nip width might wrinkle the recording medium P and might cause a defective conveyance of the recording medium P. Usually, an envelope is constructed of front and back sheet media overlapping each other with a flap that can be folded over to enclose, e.g., a letter. The sheet media are generally thicker than plain paper. Upon printing on the envelop, a relatively wide fixing nip might cause a slight linear velocity difference or a difference of power that opens the overlapping sheet media in a width direction between the sheet medium facing the fixing roller and the sheet medium facing the pressure roller. If such a difference cannot he absorbed at opposed ends of the envelope, there might be, e.g., flap deviation or wrinkles in the envelope.

Hence, in the present embodiment, the controller 22 controls a moving distance of the pressure roller 17 moved by the pressure roller moving mechanism 18 toward the fixing roller 15, depending on a predicted amount of thermal expansion of the fixing roller 15, thereby adjusting the width of the fixing nip N so as to maintain a substantially constant width of the fixing nip N.

Figure 3:
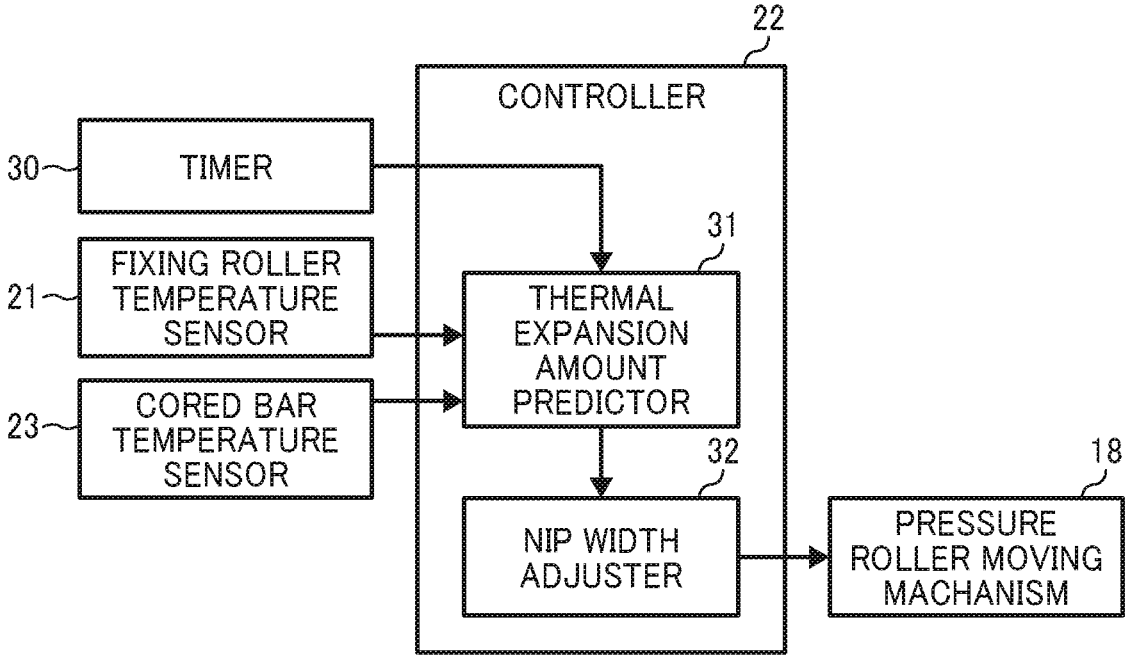
FIG. 3 is a block diagram illustrating a control structure related to nip width adjustment.

Referring now to FIG. 3, a detailed description is given of nip width adjustment according to an embodiment of the present disclosure.

FIG. 3 is a block diagram illustrating a control structure related to nip width adjustment.

The controller 22 is operatively connected to the pressure roller moving mechanism 18, the fixing roller temperature sensor 21, and the cored bar temperature sensor 23. The controller 22 includes, as its functions, a thermal expansion amount predictor 31 and a nip width adjuster 32. The thermal expansion amount predictor 31 predicts an amount of thermal expansion of the fixing roller 15 while the recording medium P is conveyed. The nip width adjuster 32 controls a moving distance of the pressure roller 17 moved by the pressure roller moving mechanism 18 toward the fixing roller 15, so as to adjust the width of the fixing nip N. More specifically, the nip width adjuster 32 controls the moving distance of the pressure roller 17 depending on an amount of thermal expansion of the fixing roller 15 predicted by the thermal expansion amount predictor 31, so as to maintain a substantially constant width of the fixing nip N.

As described above, the fixing device 11 includes the fixing roller temperature sensor 21 and the cored bar temperature sensor 23 as temperature detectors to detect the temperature of the fixing roller 15. The fixing device 11 further includes a timer 30, operatively connected to the controller 22, to detect or measure an elapsed time from when the heater 24 starts heating. The fixing roller 15 is heated and expanded while the recording medium P is conveyed, to fix a toner image T onto the recording medium P. The thermal expansion amount predictor 31 predicts the amount of thermal expansion of the fixing roller 15 based on the temperature detected by the fixing roller temperature sensor 21 and/or the cored bar temperature sensor 23, and based on the elapsed time detected by the timer 30.

The cored bar temperature sensor 23 is a contact sensor that detects the temperature of the cored bar 15*a* of the fixing roller 15. For example, the cored bar temperature sensor 23 is disposed at an end of the cored bar 15*a* to monitor the temperature of the cored bar 15*a*. The cored bar temperature sensor 23 is, e.g., a thermistor that detects the temperature of the end of the cored bar 15*a* as a rotational shaft. Alternatively, the cored bar temperature sensor 23 may be disposed to detect the temperature of an inner circumferential surface of the cored bar 15*a*.

The timer 30 detects an elapsed time preferably from when a print job starts. Preferably, the timer 30 detects at least whether the fixing roller 15 is in a heating process or whether the fixing roller 15 is in a cooling process.

Thus, the fixing device 11 obtains an optimum nip width by calculation of a changed amount of an outer diameter of the fixing roller 15 based on the temperature of the cored bar 15*a* of the fixing roller 15 and based on the elapsed time from the start of heating, and by control of the moving distance (hereinafter referred to as pressure amount) of the pressure roller 17 moved by the pressure roller moving mechanism 18 toward the fixing roller 15, based on the changed amount of the outer diameter of the fixing roller 15 thus calculated.

Figure 4:
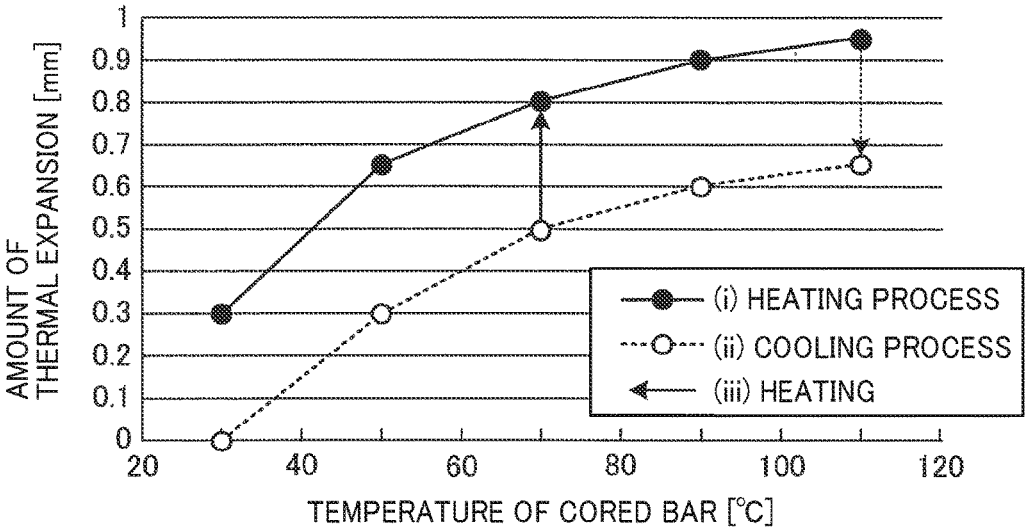
FIG. 4 is a graph illustrating a relationship between the amount of thermal expansion and the temperature of a cored bar of a fixing roller incorporated in the fixing device of FIG. 2 in heating and cooling processes.
Figure 5:
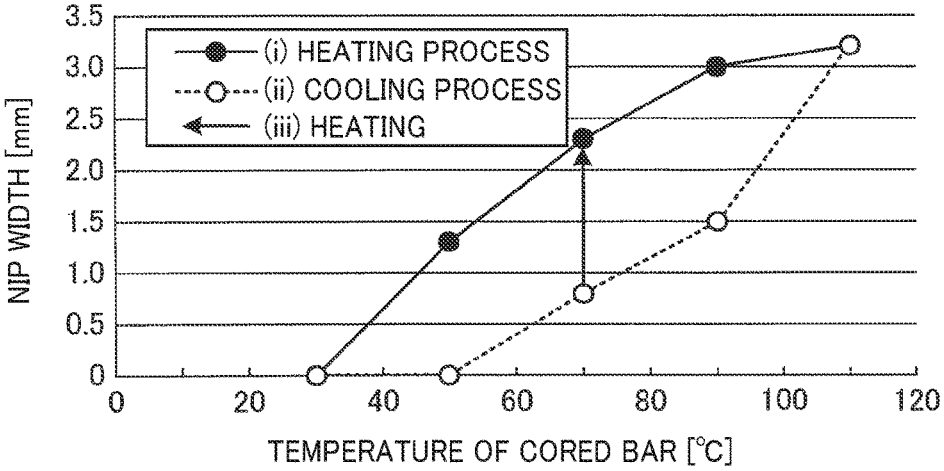
FIG. 5 is a graph illustrating a relationship between the nip width and the temperature of the cored bar of the fixing roller incorporated in the fixing device of FIG. 2 in the heating and cooling processes.

Referring now to FIGS. 4 and 5, a description is given of a relationship between the thermal expansion of the fixing roller 15 and the temperature of the cored bar 15*a* detected by the cored bar temperature sensor 23, and a relationship between the nip width and the temperature of the cored bar 15*a* detected by the cored bar temperature sensor 23 with a constant pressure amount.

FIG. 4 is a graph illustrating the relationship between the amount of thermal expansion and the temperature of the cored bar 15*a* of the fixing roller 15 in the heating and cooling processes. FIG. 5 is a graph illustrating the relationship between the nip width and the temperature of the cored bar 15*a* of the fixing roller 15 in the heating and cooling processes.

When the fixing roller 15 is in the heating process as indicated by the solid line (i) in 4, the temperature of the cored bar 15*a* and the amount of thermal expansion of the fixing roller 15 has a relatively high correlation. The temperature of the cored bar 15*a* and the nip width has a similar correlation as indicated by the solid line (i) in FIG. 5. Thus, in the heating process, the pressure amount can be adjusted depending on the temperature of the cored bar 15*a* to maintain a constant nip width.

By contrast, when the fixing roller 15 is in the cooling process as indicated by the broken lines (ii) in FIGS. 4 and 5, the temperature of the cored bar 15*a* is correlated to the amount of thermal expansion of the fixing roller 15 and the nip width. However, the amount of thermal expansion of the fixing roller 15 and the nip width in the cooling process are different from the amount of thermal expansion of the fixing roller 15 and the nip width in the heating process, respectively, because of external heating and radiation of heat.

When the fixing roller 15 is heated from outside, the elastic layer 15*b* of fixing roller 15 is heated first. Therefore, when the heat reaches the cored bar 15*a*, the elastic layer 15*b* is heated enough to expand. By contrast, when the fixing roller 15 is in the cooling process, the heat is radiated from the elastic layer 15*b* first. Therefore, the elastic layer 15*b* is cooled down before the cored bar 15*a* is cooled down, decreasing the amount of thermal expansion.

Thus, FIG, 4 illustrates a relatively large difference between the amount of thermal expansion of the fixing roller 15 in the heating process and the amount of thermal expansion of the fixing roller 15 in the cooling process. Similarly, FIG. 5 illustrates a relatively large difference between the nip width in the heating process and the nip width in the cooling process. That is, it may be difficult to specify the nip width based on the temperature of the cored bar 15*a* only.

Hence, in the present embodiment, the amount of thermal expansion of the fixing roller 15 is predicted from both the elapsed time from the start of heating and the temperature of the cored bar 15*a* to maintain a constant nip width.

As indicated by the arrows (iii) in FIGS. 4 and 5, when heating starts from the cooling process, the amount of thermal expansion and the nip width increase to respective values of the heating process while maintaining the constant temperature of the cored bar 15*a*. This is because the difference between the heating and cooling processes as described above.

Therefore, in the present embodiment, the nip width is specified by reading the temperature of the cored bar 15*a* in the heating process. Specifically, a predetermined time after conveyance of recording media starts is excluded. The pressure amount is adjusted by use of a temperature of the cored bar 15*a* detected after the predetermined time elapses.

The above-described "temperature of the cored bar 15*a* detected after the predetermined time elapses" is a temperature of the cored bar 15*a* detected when a predetermined time "t" elapses from the start of heating, or when the temperature of the cored bar 15*a* increases by a predetermined temperature "T". Preferably, an actual time of the predetermined time "t" may be from about 100 seconds to about 600 seconds whereas an actual temperature of the predetermined temperature "T" may be from about 2° C. to about 5° C.

Figure 6:
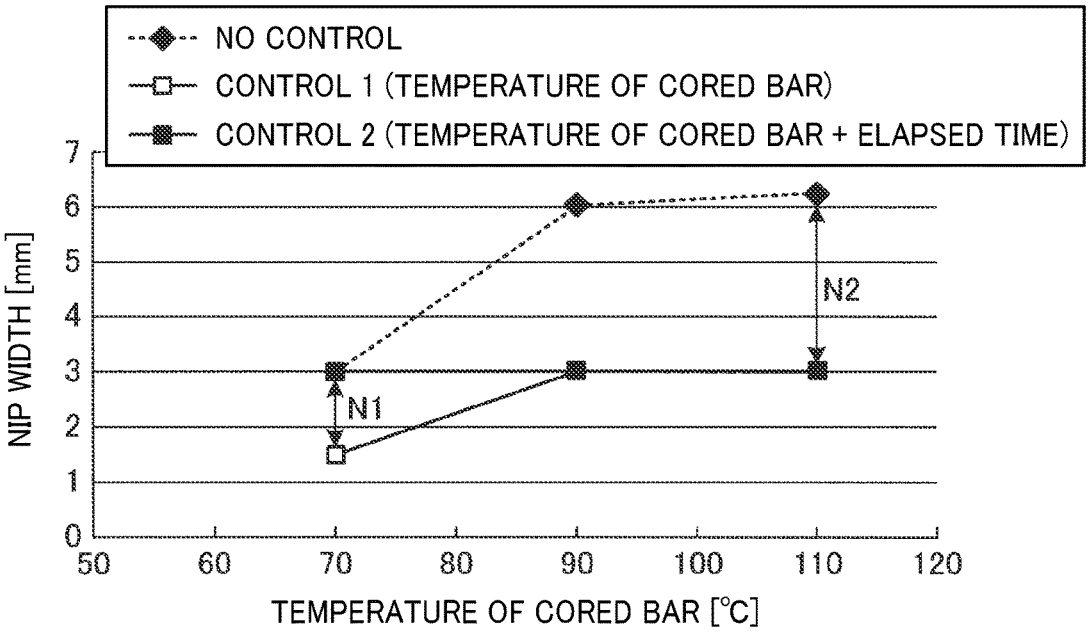
FIG. 6 is a graph illustrating a relationship between the nip width and the temperature of the cored bar of the fixing roller incorporated in the fixing device of FIG. 2 when conveyance of recording media starts at a temperature of 70° C. in the cooling process.

FIG. 6 is a graph illustrating a relationship between the nip width and the temperature of the cored bar 15*a* of the fixing roller 15 when conveyance of recording media P starts at a temperature of 70° C. in the cooling process.

Specifically, FIG. 6 illustrates the relationship between the nip width and the temperature of the cored bar 15*a* of the fixing roller 15 in three cases "no control", "control 1", and "control 2". "No control" designates a case where the pressure amount is not corrected. "Control 1" designates a case where the amount of thermal expansion is predicted based on the temperature of the cored bar 15*a* only. "Control 2" designates a case of the present embodiment, where the amount of thermal expansion is predicted based on the temperature of the cored bar 15*a* and the elapsed time. It is to be noted that a target nip width is about 3 mm.

For the case of "no control", the nip width changes as the temperature of the cored bar 15*a* increases, causing a final difference N2 from the target nip width. In other words, a constant nip width is not maintained. The case of "control 1" causes a difference N1 between an initial nip width and the target nip width. By contrast, for the case of "control 2" of the present embodiment, the fixing device 11 maintains a constant nip width regardless of the temperature of the cored bar 15*a*.

It is to be noted that the fixing device 11 is suitable for an envelope-like media envelop) as recording media.

When an envelope-like recording medium P passes through the fixing nip N having an appropriate width, overlapping portions of front and back sheets constructing the envelope-like recording medium P exhibit an increased degree of adhesion, preventing wrinkles and flap deviation.

Preferably, the nip width adjuster 32 adjusts the nip width when the recording medium P is not conveyed through the fixing nip N.

When the recording medium P enters the fixing nip N, the pressure applied to the fixing roller 15 and the pressure roller 17 increases by the thickness of the recording medium P. Such variation in pressure changes a compressed amount of the elastic layer 15*b* of the fixing roller 15. In short, the thickness of the recording medium P changes the nip width.

As described above, recording media having various degrees of thickness may be conveyed through the fixing device 11. Therefore, the nip width is preferably adjusted between consecutive recording media P, that is, when the recording medium P is absent at the fixing nip N to prevent the nip width from changing due to the thickness of the recording medium P.

Upon continuous printing, in the present embodiment, the eccentric cam 18*d* rotates when the recording medium P is absent at the fixing nip N to adjust the nip width. If the eccentric cam 18*d* rotates when the recording medium P is present at the fixing nip N to adjust the nip width, the recording medium P may exhibit variation in fixability. To prevent such variation in fixability, the nip width is adjusted when the recording medium is absent at the fixing nip N.

Figure 7:
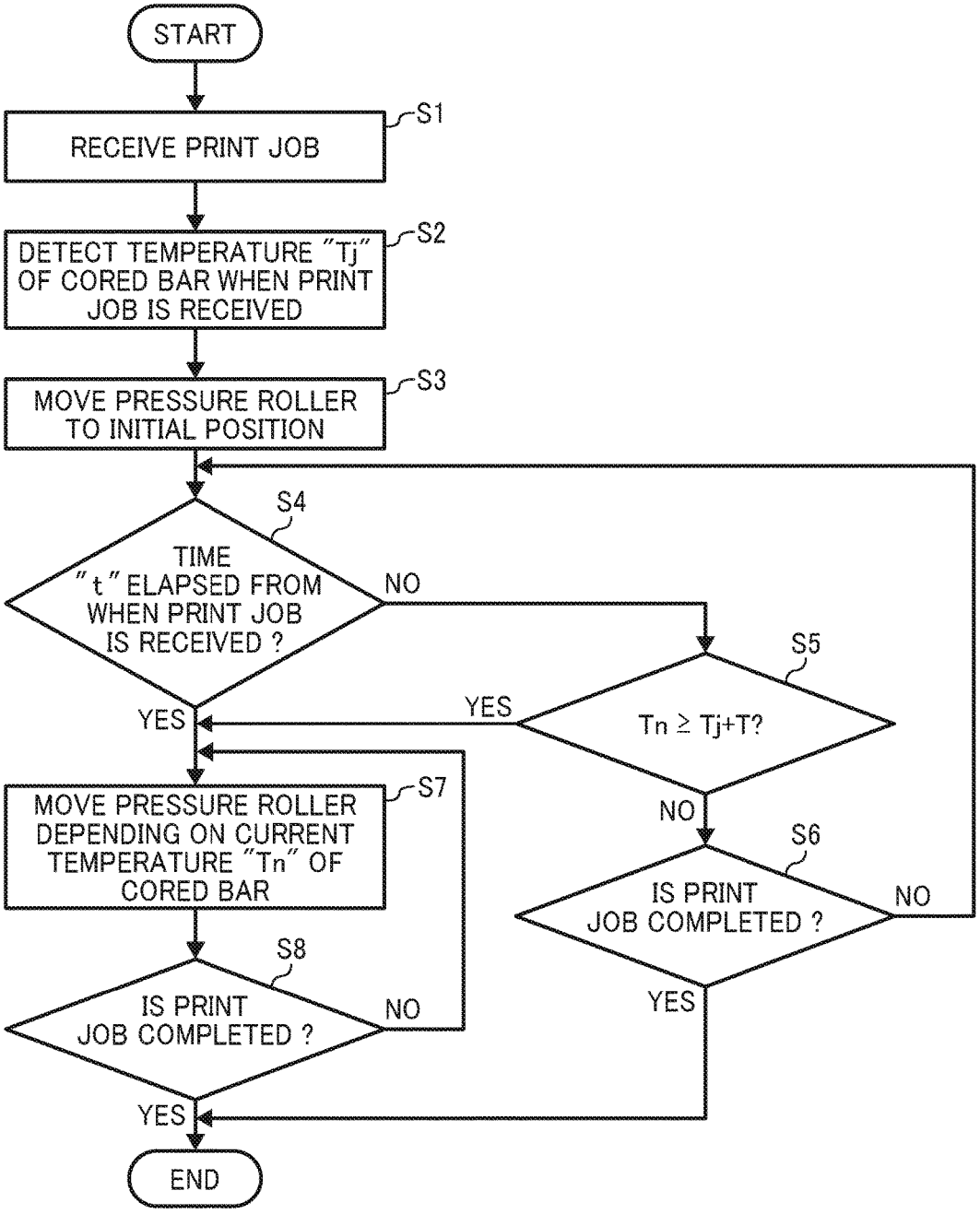
FIG. 7 is a flowchart of controlling the fixing device.

Referring now to FIG. 7, a description is now given of a method of controlling the fixing device 11 according to an embodiment of the present disclosure.

FIG. 7 is a flowchart of controlling the fixing device 11.

The controller 22 receives a print job in step S1. In step S2, the cored bar temperature sensor 23 as a cored bar temperature detector detects a temperature "Tj" of the cored bar 15*a* of the fixing roller 15 when the controller 22 receives the print job. In step S3, the pressure roller moving mechanism 18 moves the pressure roller 17 to an initial position. If the predetermined time "t" (seconds) elapses from when the controller 22 receives the print job (Yes in step S4), then the pressure roller moving mechanism 18 moves the pressure roller 17 to a position depending on a current temperature "Tn" of the cored bar 15*a* in step S7. If the time "t" (seconds) does not elapse from when the controller 22 receives the print job (No in step S4) and if the current temperature "Tn" of the cored bar 15*a* satisfies a relation of Tn Tj+T (Yes in step S5), then the pressure roller moving mechanism 18 moves the pressure roller 17 to the position depending on the current temperature "Tn" of the cored bar 15*a* in step S7. If the time "t" (seconds) does not elapse from when the controller 22 receives the print job (No in step S4) and if the current temperature "Tn" of the cored bar 15*a* does not satisfy the relation of Tn≥Tj+T (No in step S5), then the process returns to step S4 if the print job is not completed (No in step S6), or the process ends if the print job is completed (Yes in step S6). After the pressure roller moving mechanism 18 moves the pressure roller 17 to the position depending on the current temperature "Tn" of the cored bar 11.5*a* in step S7, the process ends if the print job is completed (Yes in step S8), or the process returns to step S7 if the print job is not completed (No in step S8).

Thus, according to the method of controlling the fixing device 11, the thermal expansion amount predictor 31 predicts an amount of thermal expansion of the fixing roller 15 based on a detected temperature of the fixing roller 15, and based on the elapsed time detected by the timer 30. Then, the nip width adjuster 32 controls the moving distance of the pressure roller 17 depending on the amount of thermal expansion of the fixing roller 15 thus predicted, so as to maintain a substantially constant with of the fixing nip N.

According to the control method of the present embodiment, the amount of thermal expansion of the fixing roller 15 is predicted based on the temperature of the cored bar 15*a* in the heating process. Based on the amount of thermal expansion, the pressure amount is adjusted. Therefore, the fixing device 11 obtains an optimum nip width depending on the recording medium P conveyed in the fixing device 11, thereby exhibiting a stable fixability without decreasing fixing quality.

The present disclosure has been described above with reference to specific embodiments. It is to be noted that the present disclosure is not limited to the details of the embodiments described above, but various modifications and enhancements are possible without departing from the scope of the present disclosure. It is therefore to be understood that the present disclosure may be practiced otherwise than as specifically described herein. For example, elements and/or features of different embodiments may be combined with each other and/or substituted for each other within the scope of the present disclosure. The number of constituent elements and their locations, shapes, and so forth are not limited to any of the structure for performing the methodology illustrated in the drawings.

Any one of the above-described operations may be performed in various other ways, for example, in an order different from the one described above.

Further, any of the above-described devices or units can be implemented as a hardware apparatus, such as a special-purpose circuit or device, or as a hardware/software combination, such as a processor executing a software program.

Further, as described above, any one of the above-described and other methods of the present disclosure may be embodied in the form of a computer program stored in any kind of storage medium. Examples of storage mediums include, but are not limited to, flexible disk, hard disk, optical discs, magneto-optical discs, magnetic tapes, non-volatile memory cards, read only memory (ROM), etc.

Alternatively, any one of the above-described and other methods of the present disclosure may be implemented by an application specific integrated circuit (ASIC), prepared by interconnecting an appropriate network of conventional component circuits or by a combination thereof with one or more conventional general purpose microprocessors and/or signal processors programmed accordingly.

What is claimed is:

1. A method of controlling a fixing device, the method comprising:

predicting an amount of thermal expansion of a fixing rotator of the fixing device based on a detected temperature of the fixing rotator and a detected elapsed time from when heating starts; and controlling a moving distance of a pressure rotator of the fixing device depending on the amount of thermal expansion of the fixing rotator predicted, so as to maintain a substantially constant width of a fixing nip between the fixing rotator and the pressure rotator.

2. A fixing device comprising:

a heater;

a fixing rotator including a cored bar and an elastic layer coating the cored bar;

a pressure rotator to press against the elastic layer of the fixing rotator to form a fixing nip between the fixing rotator and the pressure rotator, through which a recording medium is conveyed;

a moving device to move the pressure rotator in directions in which the pressure rotator comes into contact with and separates from the fixing rotator;

a thermal expansion amount predictor to predict an amount of thermal expansion of the fixing rotator while the recording medium is conveyed; and a nip width adjuster to control a moving distance of the pressure rotator moved by the moving device toward the fixing rotator, so as to adjust a width of the fixing nip, the nip width adjuster controlling the moving distance of the pressure rotator depending on the amount of thermal expansion of the fixing rotator predicted by the thermal expansion amount predictor, so as to maintain a substantially constant width of the fixing nip.

3. The fixing device according to claim 2, wherein the recording medium is an envelope.

4. The fixing device according to claim 2, further comprising:

a temperature detector to detect a temperature of the fixing rotator; and a timer to detect an elapsed time from when the heater starts heating, wherein the thermal expansion amount predictor predicts the amount of thermal expansion of the fixing rotator based on the temperature detected by the temperature detector and the elapsed time detected by the timer.

5. The fixing device according to claim 4, wherein the fixing rotator is a roller including a cored bar, and wherein the temperature detector is a cored bar temperature detector to detect a temperature of the cored bar of the fixing rotator.

6. The fixing device according to claim 4, wherein the timer detects an elapsed time from when a print job starts.

7. The fixing device according to claim 2, wherein the nip width adjuster adjusts the width of the fixing nip when the recording medium is not conveyed through the fixing nip.

8. An image forming apparatus comprising:

an image forming device to form a toner image; and a fixing device disposed downstream from the image forming device in a recording medium conveyance direction to fix the toner image on a recording medium, the fixing device including:

a heater;

a fixing rotator including a cored bar and an elastic layer coating the cored bar;

a pressure rotator to press against the elastic layer of the fixing rotator to form a fixing nip between the fixing rotator and the pressure rotator, through which the recording medium is conveyed;

a moving device to move the pressure rotator in directions in which the pressure rotator comes into contact with and separates from the fixing rotator;

a thermal expansion amount predictor to predict an amount of thermal expansion of the fixing rotator while the recording medium is conveyed; and a nip width adjuster to control a moving distance of the pressure rotator moved by the moving device toward the fixing rotator, so as to adjust a width of the fixing nip, the nip width adjuster controlling the moving distance of the pressure rotator depending on the amount of thermal expansion of the fixing rotator predicted by the thermal expansion amount predictor, so as to maintain a substantially constant width of the fixing nip.

* * * * *